US005727709A

United States Patent [19]

Nobile

[11] Patent Number: 5,727,709

[45] Date of Patent: Mar. 17, 1998

[54] THERMALLY INSULATED FLOATING BEVERAGE CONTAINER HOLDING DEVICE

[76] Inventor: John R. Nobile, 65 Forest Ave., Fairfield, Conn. 06430

[21] Appl. No.: 645,093

[22] Filed: May 13, 1996

[51] Int. Cl.[6] ..... B65D 43/24

[52] U.S. Cl. ..... 220/560; 220/603

[58] Field of Search ..... 220/603, 560, 220/739

[56] References Cited

U.S. PATENT DOCUMENTS

| | | | |
|---|---|---|---|
| 151,261 | 5/1874 | Woerle | 220/560 |
| 1,370,432 | 3/1921 | Gvosdenovich | 220/560 |
| 2,531,562 | 11/1950 | Eve | 220/560 |
| 3,015,406 | 1/1962 | Nolte | 220/560 |
| 4,303,170 | 12/1981 | Panicci | 220/603 |
| 4,802,602 | 2/1989 | Evans et al. | 220/85 |
| 4,927,041 | 5/1990 | Hepburn | 220/560 |
| 5,005,717 | 4/1991 | Oilar | 215/13.1 |
| 5,088,948 | 2/1992 | Scheurer | 220/603 |
| 5,447,764 | 9/1995 | Langford | 220/560 |

*Primary Examiner*—Joseph M. Moy
*Attorney, Agent, or Firm*—Martin D. Wittstein

[57] ABSTRACT

A thermally insulated floating beverage container holding device is disclosed which has an elongate body member having a peripheral side wall and a bottom wall closing the side wall to form a chamber for receiving a typical round bottle or aluminum can beverage container therein. The side wall has an upper portion that is substantially thicker than the remaining portion of the side wall to provide floation for the holding device, and a weight is suitably secured to the bottom of the holding device to proide sufficient stability that the device holds a beverage container upright both when immersed in water so that neither will beverage spill from the container nor will water get into the container to contaminate the beverage, and when the device is placed on a dry surface.

11 Claims, 3 Drawing Sheets

THERMALLY INSULATED FLOATING BEVERAGE CONTAINER HOLDING DEVICE

BACKGROUND OF THE INVENTION

This invention relates generally to holding devices for beverage containers, such as bottles and cans, and more particularly to such devices which are formed of a sufficiently insulating and buoyant material to maintain the beverage at a desired temperature and at the same time support the container in water, such as a pool or the like, or on a dry surface.

It is well known that during warm weather conditions, it is common for people to remain cool outdoors by floating in a swimming pool or other body of water. Numerous types of flotation devices have been developed for this purpose, such as inflatable or fixed frame and web water chaises, inflatable mattresses of many different configurations and various other devices which permit a person to float with a major portion of his body immersed in the water. This practice has become quite commonplace with the advent and development of back yard swimming pools, of which a variety are available.

During this activity, it is also commonplace for one to drink a chilled beverage, typically a beverage packaged in a bottle or an aluminum can such as soda, iced tea or beer. Under these circumstances, it is desirable both that the beverage remain cold for as long as possible, and that the person drinking it have some facility for putting down the beverage container without risk of spilling when he is not drinking.

The first problem, i.e., maintaining the beverage cold, is effectively solved by a variety of well known holding devices for insulating a beverage container, and which are typically used outdoors in warm weather conditions where ambient temperatures will rapidly warm a chilled beverage to an unpalatable temperature before it can be consumed if the container is not stored in an insulating holder. Such known are generally quite effective to hold a beverage container securely and upright when they placed on a supporting surface. However, these devices do not address the second problem, i.e., that of being able to put the container down while floating in a pool, since the known insulated beverage container holders are not designed to float while holding a container that is full of beverage. Although many of the insulating materials presently used in the manufacture of insulating beverage container holders have some degree of buoyancy, it is insufficient to maintain a full beverage container above the surface of the water and in a sufficiently upright manner to prevent the beverage from spilling or water getting into the container.

Flotation devices do exist for holding a beverage container on the surface of water. Typically these devices comprise a generally donut shaped inflatable or solid material ring having a web extending across the central opening on which one can place a container. These devices, however, are not satisfactory for the purposes stated above because firstly a container resting on the central web is not not supported in a stable manner since the floation ring is susceptable to wave motion of the water, and secondly they have no provision for insulating the beverage container against ambient temperature to maintain the beverage cold.

Thus, it is apparent that there is a need for a beverage container holding device that is both sufficiently insulated to prevent the beverage from becoming unpalatably warm under the ambient temperature conditions in which the device is intended for use, and which has sufficient buoyancy that it will float while supporting a full beverage container with sufficient stability that the neither the beverage in the container will spill during moderately rough wave action nor will water enter the container to contaminate the beverage.

BRIEF SUMMARY OF THE INVENTION

The present invention substantially aleviates if not entirely eliminates the foregoing disadvantages and shortcomings of known beverage container holding devices. The present invention has the advantages of being well insulated in order to maintain beverage in glass bottles or aluminum cans palatably chilled for a relatively long period of time, having sufficient buoyancy to maintain a full beverage container above the surface of the water with sufficient statility that neither will beverage spill from the container nor will water enter it to contaminate the beverage, has a unique design which contributes to the stability of the holder when immersed in water also makes it convenient and easy to hold, and is stable on a flat surface.

Thus, in their broader aspects, the principles of the present invention are embodied in a thermally insulated floating beverage container holding device comprising an elongate body member having a peripheral side wall defining a hollow chamber, means adjacent one end of the side wall for supporting a beverage container within the chamber, the other end of the peripheral wall being open to receive the beverage container within the chamber, and means operatively associated with the peripheral side wall for providing the side wall with thermally insulating and buoyant characteristics. A floatation means surrounds an upper portion of the peripheral side wall for causing the body member to float in a substantially upright position, and ballast mean is disposed adjacent the beverage container supporting means for assisting in maintaining the holding device in the upright position when the holding device is immersed in water, whereby when the holding device is so immersed with a beverage container therein, the holding device floats in an upright position with sufficient stability and buoyancy to prevent beverage from spilling from the beverage container and to prevent water from entering the beverage container and contaminating the beverage therein.

In some of its more limited aspects, the floatation means extends axially for a distance less than one half of the total length of the peripheral side wall, and is approximately three times the thickness of the remaining portion of the peripheral side wall, thereby providing sufficient buoyancy to prevent the holding device from turning over and spilling beverage from the container when the holding device is immersed in water.

In one embodiment of the invention, the means for providing the thermal and buoyant characteristics of the peripheral side wall comprises the peripheral side wall being formed of a thermal insulating and buoyant material. In another embodiment of the invention, this means comprises the pheripheral side wall being formed as a hollow, sealable inflatable member defining an air chamber therein. In a variation of this embodiment, the inflatable bladder of the side wall terminates at the juncture of the side wall with the floatation means, and the floatation means comprises a separate hollow, sealable inflatable bladder defining an air chamber therein.

In all of the embodiments, the means for supporting the beverage container may be a bottom wall closing one end of the peripheral side wall, and the ballast means comprises a weight affixed to the bottom wall. Alternatively, the means for supporting the beverage container comprises a radially inturned flange secured to the peripheral side wall adjacent the aforementioned end, and the ballast means comprises an annular weight affixed to the flange. Also, it is preferable, in any of the foregoing embodiments of the invention, that the floatation means be provided with a plurality of apertures extending therethrough in an axial direction for attaching a carrying strap to the beverage container holding device.

Having briefly described the general nature of the present invention, it is a principal object thereof to provide an insulated floating beverage container holding device which both maintains a chilled beverage at a palatable temperature and permits the user to put the holding device down in water without beverage spilling from the container or water getting into the container to contaminate the beverage.

Another object of the present invention to provide an insulated floating beverage container holding device which is designed and constructed to have sufficient buoyancy and stability to remain substantially upright even in modestly rough water to prevent beverage from spilling from the container or water entering the container and contaminating the beverage.

It is another object of the present invention to provide an insulated floating beverage container holding device which is designed and constructed such that the combination of thermally insulating and buoyant characteristics render it equally suitable for use in water or on a dry surface.

It is still another object of the present invention to provide an insulated floating beverage container holding device which has features of design and construction that render it easy to grasp and hold, is inexpensive to manufacture and market, requires virtually no maintenance and is easy to carry from place to place.

These and other objects and advantages of the present invention will become more apparent from an understanding of the following detailed description of presently preferred embodiments of the present invention when considered in conjunction with the accompanying drawings.

DETAILED DESCRIPTION OF THE INVENTION

Figure 1:
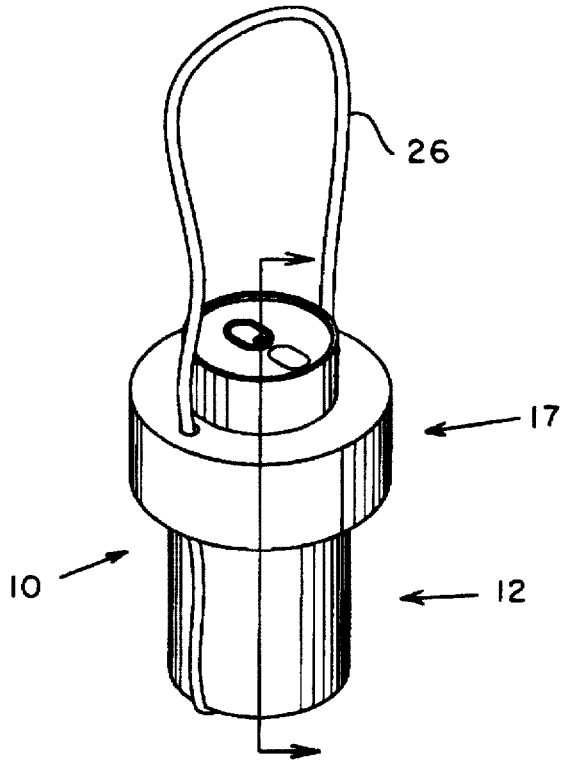
FIG. 1 is a perspective view of one embodiment of the present invention showing the holding device in complete form with a typical beverage container therein.
Figure 2:
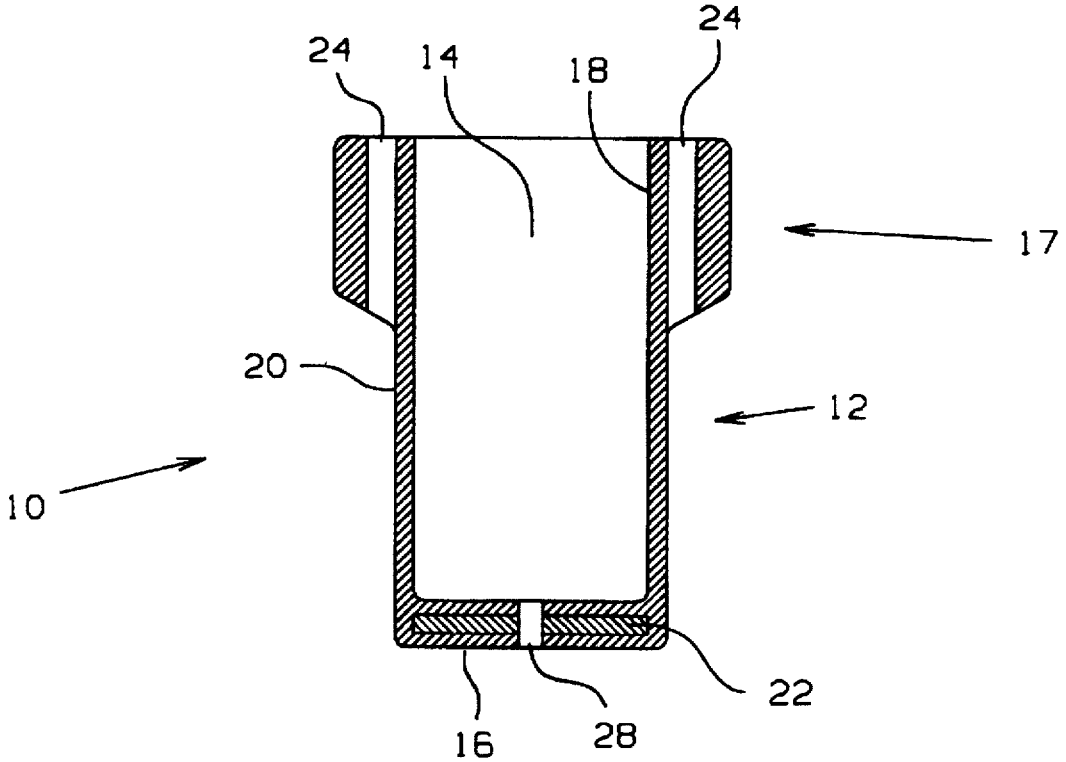
FIG. 2 is a sectional view taken on the line 2—2 of FIG. 1 with the beverage container removed, showing the floatation means as formed integrally with the body member of thermally insulating and buoyant material.

Referring now to the drawings, and particular to FIGS. 1 and 2 thereof, the beverage container holding device of the present invention comprises an elongate body member, designated generally by the reference numeral 10, having a peripheral side wall, designated generally by the reference numeral 12, which defines a chamber 14 therein and which may be tubular as shown or other suitable configuration depending on the shape of the beverage container with which the device is intended for use. Typically the body member 10 will have a tubular configuration as shown since the most common forms of beverage containers are round aluminum cans or glass bottles.

The body member 10 includes means adjacent one end of the side wall 12 for supporting a beverage container therein, and which, in the embodiment shown in FIG. 2, is a bottom wall 16 which closes one end of the side wall 12 to support the beverage container when it is fully inserted into the chamber 14. The other end of the side wall 12 remains open to permit instant access to the chamber 14 to facilitate easy insertion and removal of the beverage container to and from the chamber 14. It will be understood that the overall length of the peripheral side wall 12 is generally commensurate with that of the typical soda or beer can, or with that of the wide portion of a bottle, generally in the range of six to seven inches. It is not essential that an entire beverage container be disposed within the chamber 14, but the more it is disposed within the chamber, the better will be both the thermal insulating characteristic and the stability of the holding device either when it is immersed in water or placed on a dry surface.

A floatation means, indicated generally by the reference numeral 17, surrounds an upper portion 18 of the peripheral side wall 12 for causing the body member 10 to float in a substantially upright position. In the embodiment shown in FIGS. 1 and 2, the floatation means 17 comprises the upper portion 18 of the side wall 12 being formed integrally with, and being substantially thicker than, the remaining portion 20 of the side wall 12, and which extends axially for a distance of substantially less than one half of the overall length of the side wall 12. It has been found that an upper portion 18 having a length of approximately one quarter to one third of the overall length of the side wall 12, and with a thickness of approximately three times that of the lower portion 20 of the side wall 12, affords the best range of both thermal insulation of the beverage container within the holding device and stability of the holding device both when immersed in water and positioned on a dry surface. Thus, the thickness of the entire length of the side wall 12 is selected to provide sufficient thermal insulating characteristic to maintain beverage in the beverage container at a palatably cold temperature for the average length of time that is required to consume the beverage, and yet does not provide sufficient buoyancy to render the holding device unstable when immersed in water, even when the beverage container is nearly empty. The upper portion 18 provides all of the flotation necessary to maintain the body member 10 upright and with the top of the beverage container above the surface of the water, even when the beverage container is full.

The beverage container holding device is provided with means operatively associated with the side wall 12 for providing the side wall 12 with thermally insulating and buoyant characteristics. In the embodiment shown in FIGS. 1 and 2, this means comprises the side wall 12 and the floatation means 17 both being formed as a single piece of a thermally insulating and buoyant material. Many such materials are well known, such as various compositions of foam material which are highly porous and therefore have excellent thermal insulating capability and are also quite buoyant due to the volume of air that is trapped in the body of the material.

The body member 10 is provided with a suitable ballast means disposed adjacent the beverage container supporting means for assisting in maintaining the body member 10 in an upright position, and in the embodiment shown in FIG. 2, this means comprises a weight 22 which is disposed adjacent the bottom wall 16, and may actually be attached thereto or molded therein if desired. The purpose of the weight 20 is twofold; firstly, it functions in conjunction with the floatation means 17 to maintain the body member 10 in a sufficiently upright position when it is immersed in water to prevent beverage from spilling from the container or water entering the container and contaminating the beverage. Also it provides the body member 10 with sufficient stability when it is positioned on a dry surface that it will not easily fall over, such as if it is inadvertently lightly pushed or is subjected to a slight breeze. Thus, keeping the weight 20 as low as possible in the body member 10 maximizes its stability both in the water and on a dry surface.

It will further be seen that the floatation means 17 is provided with a pair of axially extending apertures 24 therethrough through which the ends of a carrying strap 26 are passed and secured to facilitate carrying the holding device from place to place.

Both the bottom wall 16 and the weight 22 are provided with a central aperture 28 so that a beverage container can easily be inserted into or removed from the chamber 14 without trapping air 40 or water therein beneath the bottom of the beverage container. The diameter of the peripheral side wall 12 is selected such that the inner surface thereof forms a substantially tight fit with the outer surface of the beverage container. Thus, without the aperture 22, it would be difficult to insert or remove the beverage container because air could not readily pass between these surfaces.

Figure 3:
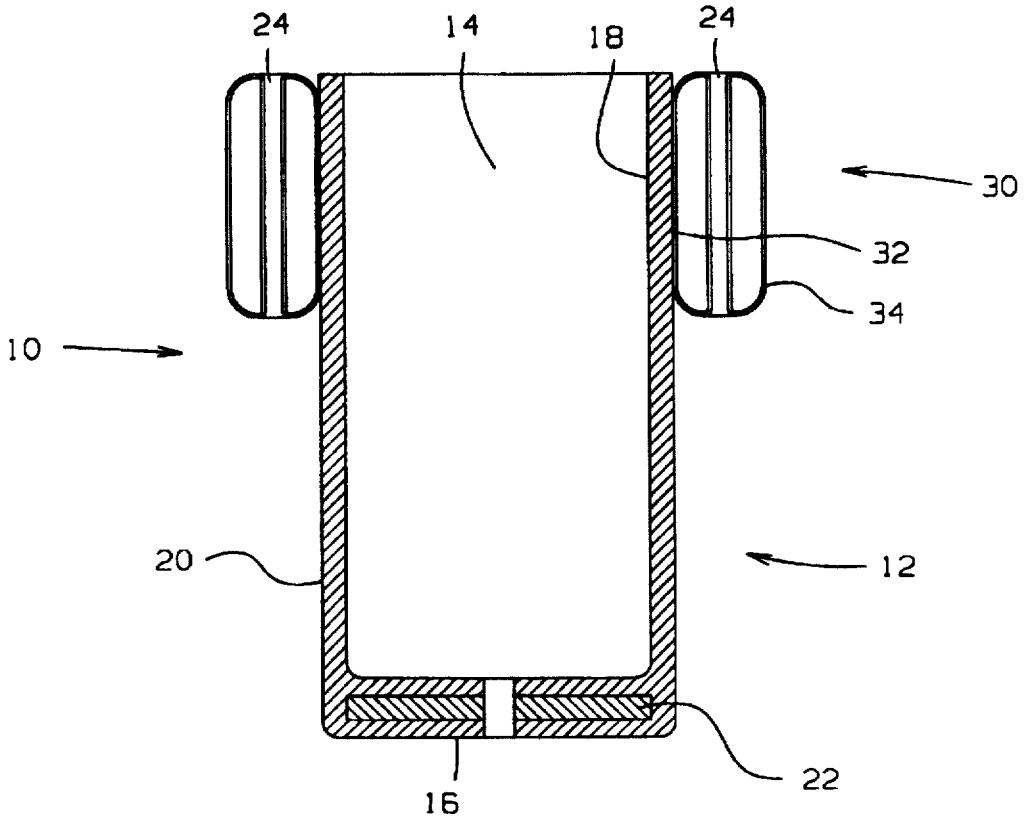
FIG. 3 is a view similar to FIG. 2 of another embodiment of the invention in which the floatation means is formed as a hollow, sealable inflatable bladder.

In another embodiment of the invention shown in FIG. 3, the side wall 12 extends the full height of the holding device, and the integral floatation means 17 of the previous embodiment is replaced with an annular inflatable bladder, indicated generally by the numeral 30, that surrounds the upper portion 18 of the side wall 12 for approximately the same distance as in the previous embodiment, i.e., about one third of the full height. The bladder 30 is a hollow, sealable inflatable member and retains the gas therein to maintain the shape shown unless it is punctured, and the air trapped between the inner and outer walls 32 and 34 respectively provides all of the buoyancy that is required to maintain the body member 10 in a sufficiently stable upright position when immersed in water to prevent beverage from spilling from the beverage container and also to prevent water from entering the beverage container and contaminating the beverage. It is also provided with the same elongate apertures 24 that are provided in the previous embodiment through which the ends of the carrying strap 26 extend to secure the carrying strap 26 to the holding device.

Figure 4:
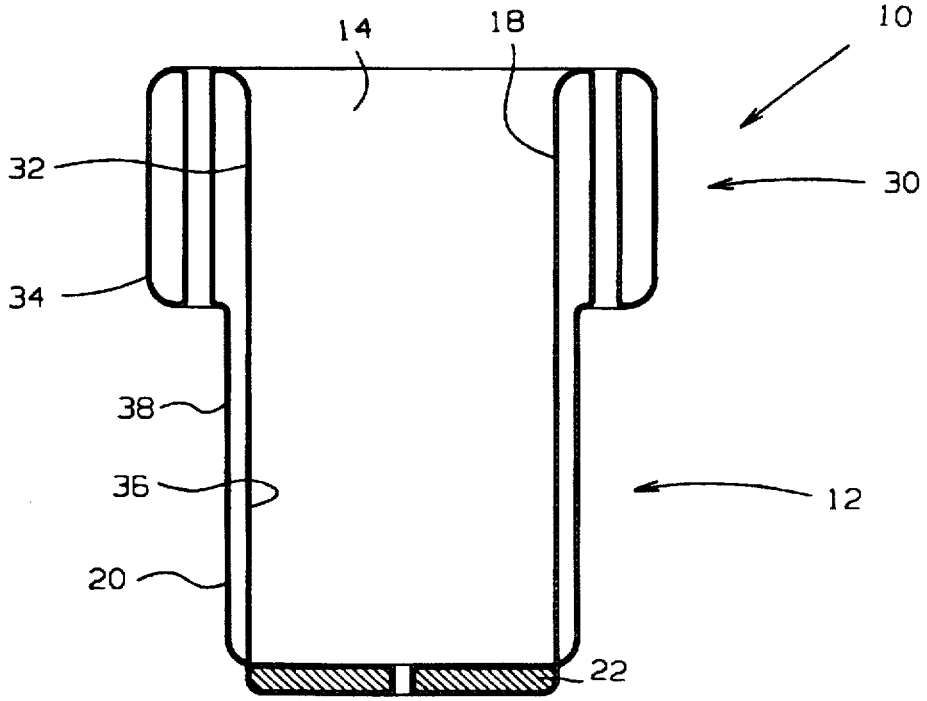
FIG. 4 is a view similar to FIG. 2 of still another embodiment of the invention in the peripheral side wall and the floatation means is formed as a hollow, sealable inflatable bladder.

In still another embodiment of the invention shown in FIG. 4, the entire peripheral side wall 12, including both the lower portion 20 and the upper portion 18, is formed as a hollow, sealable inflatable bladder. Thus, the lower portion 20 of the peripheral side wall 12 forms a first hollow, sealable inflatable bladder which terminates adjacent the juncture of the side wall 12 with the floatation bladder 30, and the floatation bladder 30 forms a second hollow, sealable inflatable bladder, the two bladders being joined together at the juncture to form a single hollow, sealable inflatable bladder which extends the full height of the body member 10. The air trapped between the inner and outer walls 36 and 38 of the lower portion 20, and 32 and 34 of the floatation bladder 30 provide both the thermal insulating and buoyancy characteristics.

Figure 5:
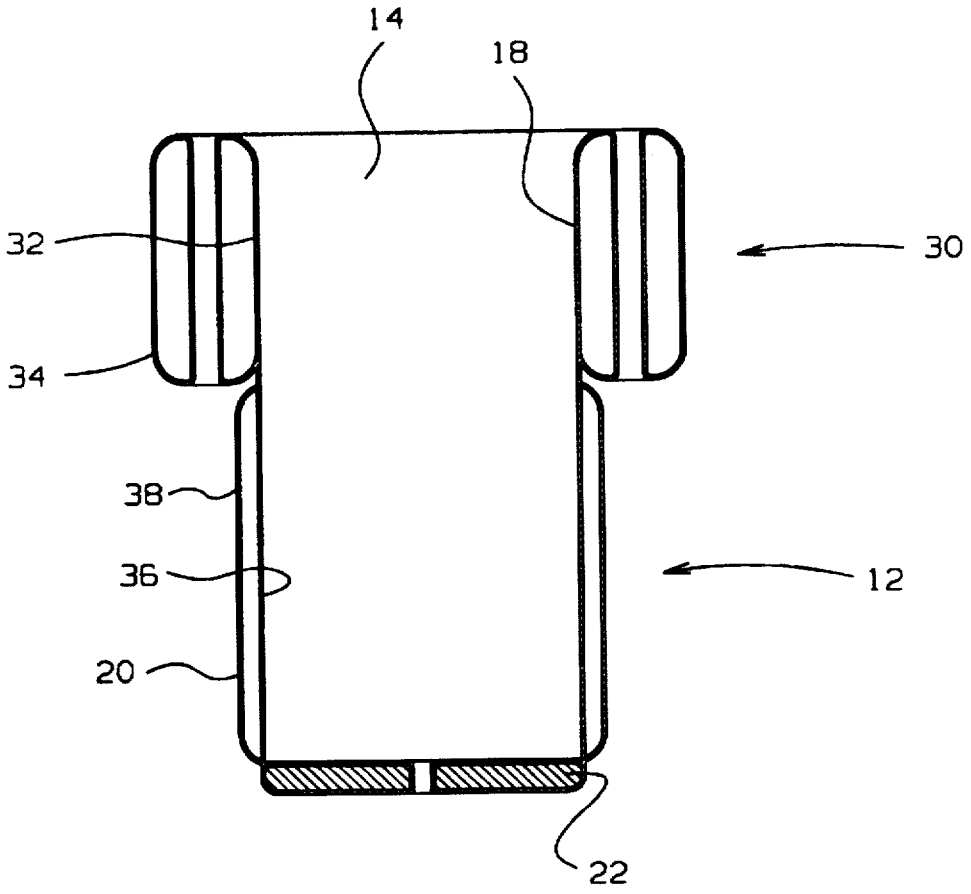
FIG. 5 is a view similar to FIG. 2 showing a variation of the embodiment shown in FIG. 4 in which the peripheral side wall and the floatation means are formed as separate hollow, sealable inflatable bladders.

A variation of the embodiment shown in FIG. 4 is illustrated in FIG. 5, which is substantially the same as that shown in FIG. 4 with the exception that the floatation bladder 30 is separate and distinct from the bladder which constitutes the lower portion 20 of the side wall 12. The advantage of this arrangement is that if one section is punctured, the holding device will still remain at least partly functional until it can be replaced.

Figure 6:
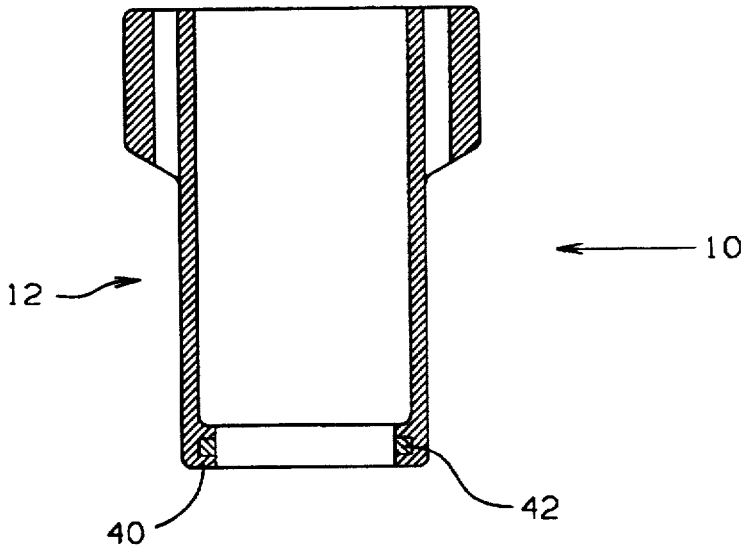
FIG. 6 is a view similar to FIG. 2 of an alternate form of beverage container supporting means which is applicable to all embodiments of the invention.

FIG. 6 illustrates a variation of the means for supporting the beverage container as shown in FIGS. 1 and 2, in which most of the bottom wall 16 is eliminated, and only a relatively short inturned flange 40 remains that is integrally connected to the peripheral side wall 12 as was the case in the embodiment of FIGS. 1 and 2. With this arrangement, the ballast means is now an annular weight 42 which is secured to or imbedded within the material of the flange, although other means of providing ballast at or near the bottom of the side wall 12 could be provided. One advantage of this arrangement is that it becomes easier to remove a beverage container from the body member 10 because it can be pushed out of the open end of the body member 10 by pushing directly on the bottom surface of the beverage container rather than the using having to grasp the other end of the container and either pull it out or push it upwardly by pushing on the bottom wall 16.

It is to be understood that the present invention is not to be considered as limited to the specific embodiments described above and shown in the accompanying drawings, which is are merely illustrative of the best modes presently contemplated for carrying out the invention and which are susceptible to such changes as may be obvious to one skilled in the art, but rather that the invention is intended to cover all such variations, modifications and equivalents thereof as may be deemed to be within the scope of the claims appended hereto.

I claim:

1. A thermally insulated floating beverage container holding device comprising:

A. an elongate body member having a peripheral side wall defining a chamber,

B. means adjacent one end of said side wall for supporting a beverage container within said chamber, the other end of said peripheral wall being open to receive said beverage container within said cheer, C. means operatively associated with said peripheral side wall for providing said side wall with thermally insulating and buoyant characteristics, D. floatation means surrounding an upper portion of said peripheral side wall for causing said body member to float in a substantially upright position, said floatation means extending axially for a distance less than one half of the length of said peripheral side wall and having a configuration which extends said floatation means radially beyond said side wall, and E. ballast means disposed adjacent said beverage supporting means for assisting in maintaining said holding device in said upright position when said holding device is immersed in water, said floatation means and said ballast means being provided in a proportion of floatation characteristic to ballast that will maintain said holding device substantially in said upright position during depletion of the beverage in said beverage container from full to empty, whereby when said holding device is immersed in water with a beverage container therein, said holding device floats in an upright position with sufficient stability and buoyancy to prevent beverage from spilling from said beverage container and to prevent water from entering said beverage container and contaminating the beverage therein.

2. A thermally insulated floating beverage container holding device as set forth in claim 1 wherein said floatation means is approximately three times the thickness of the remaining portion of said pheripheral side wall.

3. A thermally insulated floating beverage container holding device as set forth in claim 2 wherein said means for providing said thermally insulating and buoyant characteristics of said peripheral side wall comprises said peripheral side wall being formed as a hollow sealable inflatable bladder defining an air cheer therein.

4. A thermally insulated floating beverage container holding device as set forth in claim 3 wherein said inflatable bladder of said side wall terminates adjacent the juncture of said side wall with said flotation means, and said floatation means comprises a separate hollow sealable inflatable bladder defining an air chamber therein.

5. A thermally insulated floating beverage container holding device as set forth in claim 2 wherein said means for providing said thermally insulating and buoyant characteristics of said peripheral side wall comprises said peripheral side wall being formed of a thermally insulating and buoyant material, and said floatation means comprises said upper portion of said side wall also being formed of a thermally insulating material.

6. A thermally insulated floating beverage container holding device as set forth in claim 2 wherein said means for providing said thermally insulating and buoyant characteristics of said peripheral side wall comprises said peripheral side wall being formed of a thermally insulating and buoyant material, and said floatation means comprises a hollow sealable inflatable bladder surrounding said upper portion of said peripheral side wall and defining an air chamber therein.

7. A thermally insulated floating beverage container holding device as set forth in claim 2 wherein said means for providing said thermally insulating and buoyant characteristics of said peripheral side wall comprises said peripheral side wall being formed as a first hollow sealable inflatable bladder which terminates adjacent the juncture of said side wall with said floatation means, and said floatation means comprises a second hollow sealable inflatable bladder surrounding said upper portion of said peripheral side wall, said first and second bladders being joined together to form a single hollow sealable inflatable bladder extending the full length of said body member.

8. A thermally insulated floating beverage container holding device as set forth in claim 7 wherein said first and second bladders are disconnected from one another to form two separate bladders.

9. A thermally insulated floating beverage container holding device as set forth in claim 1 wherein said means for supporting said beverage container comprises a bottom wall closing said one end of said peripheral side wall, and said ballast means comprises a weight affixed to said bottom wall.

10. A thermally insulated floating beverage container holding device as set forth in claim 1 wherein said means for supporting said beverage container comprises a radially inturned flange secured to said peripheral side wall adjacent said one end of said peripheral side wall, and said ballast means comprises an annular weight affixed to said flange.

11. A thermally insulated floating beverage container holding device as set forth in claim 1 wherein said floatation means is provided with a plurality of apertures extending therethrough in an axial direction for attaching a carrying strap to said beverage container holding device.

* * * * *